US006092470A

United States Patent [19]

O'Donnell

[11] Patent Number: 6,092,470

[45] Date of Patent: Jul. 25, 2000

[54] RAILROAD CAR SIDE BEARING WITH THERMAL INSULATOR

[75] Inventor: William P. O'Donnell, Plainfield, Ill.

[73] Assignee: Miner Enterprises, Inc., Del.

[21] Appl. No.: 09/205,551

[22] Filed: Dec. 3, 1998

[51] Int. Cl.[7] ..... B61F 5/00

[52] U.S. Cl. ..... 105/199.3; 384/423

[58] Field of Search ..... 105/4.1, 197.1, 105/199.1, 199.2, 199.3, 199.4, 355; 384/220, 420, 423, 448, 595, 597, 599; 267/3, 269, 292

[56] References Cited

U.S. PATENT DOCUMENTS

| | | | |
|---|---|---|---|
| 3,735,711 | 5/1973 | Hassenauer | 105/199.3 |
| 3,910,655 | 10/1975 | Willison et al. | 105/199.3 |
| 3,932,005 | 1/1976 | Miller | 105/199.3 |
| 4,355,583 | 10/1982 | Eggert, Jr. | 105/199.3 |
| 4,712,487 | 12/1987 | Carlson | 105/199.3 |
| 4,793,720 | 12/1988 | Merker, Jr. | 384/423 |
| 4,859,089 | 8/1989 | Wright | 384/423 |
| 4,924,779 | 5/1990 | Curtis et al. | 105/4.1 |
| 4,998,997 | 3/1991 | Carlson | 267/3 |
| 5,086,707 | 2/1992 | Spencer et al. | 105/199.3 |
| 5,386,783 | 2/1995 | Rhen et al. | 105/199.3 |
| 5,601,031 | 2/1997 | Carlson | 105/199.3 |

*Primary Examiner*—Jesus D. Sotelo
*Assistant Examiner*—Lars A. Olson
*Attorney, Agent, or Firm*—John W. Harbst

[57] ABSTRACT

A railroad car side bearing is disclosed. The railroad car side bearing includes a housing, an upper member arranged in spaced relation relative to the housing, an elastomeric spring disposed between the housing and the upper member, and a thermal insulator for restricting heat transfer between the upper member of the railroad car side bearing and the elastomeric spring.

60 Claims, 1 Drawing Sheet

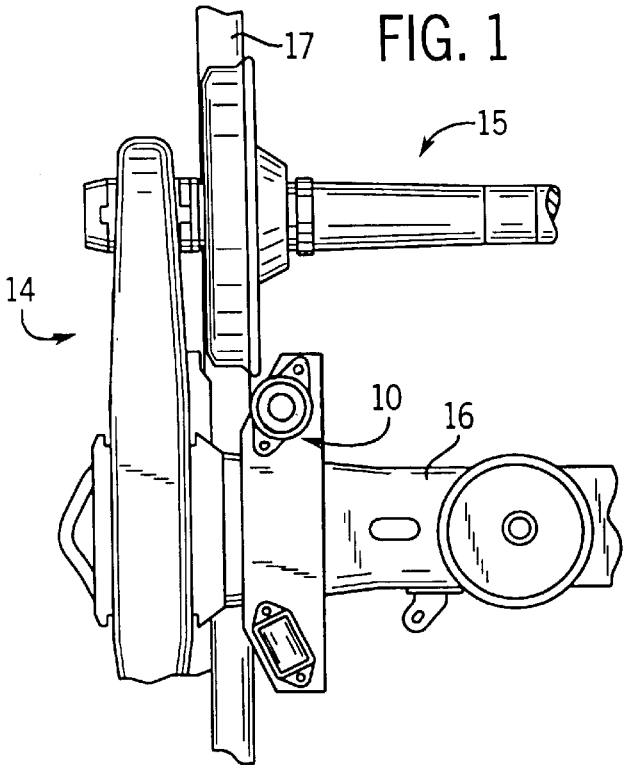
FIG. 1
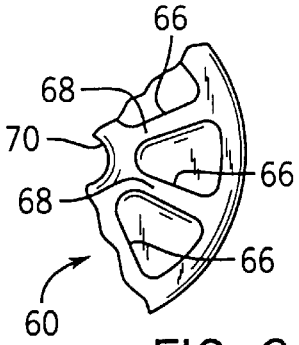
FIG. 3
FIG. 2
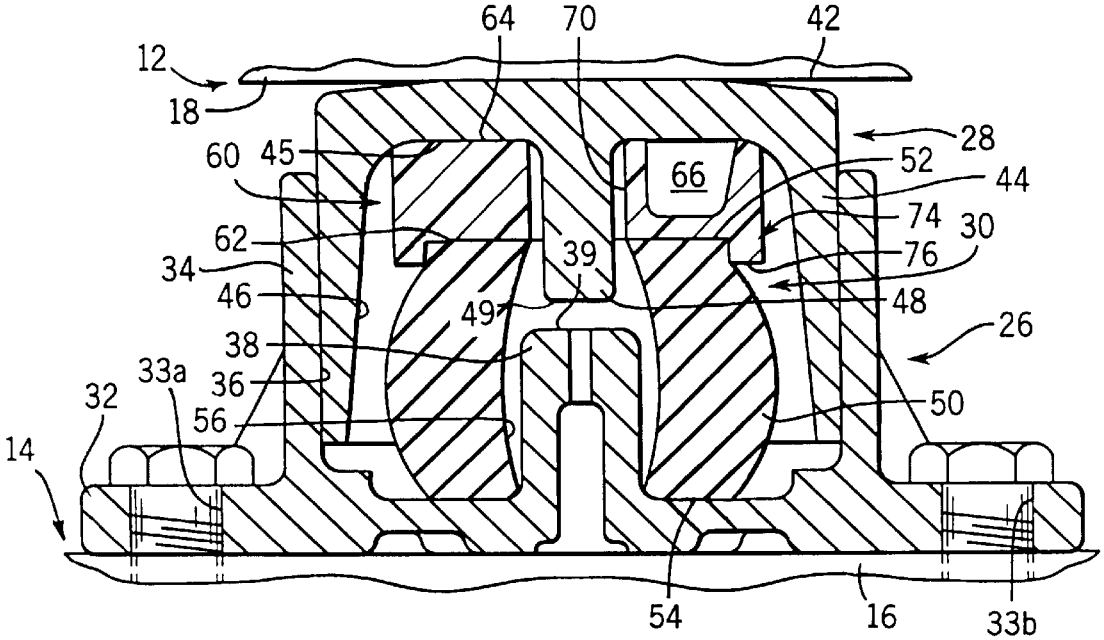

RAILROAD CAR SIDE BEARING WITH THERMAL INSULATOR

FIELD OF THE INVENTION

The present invention generally relates to railroad car side bearings and, more particularly, to a railroad car side bearing utilizing an elastomeric spring wherein an insulator is provided for restricting transfer of heat to the elastomeric spring.

BACKGROUND OF THE INVENTION

Side bearings for railroad car are well known in the art. On a railroad car, wheeled trucks are provided toward and support opposite ends of a railcar body for movement over tracks or rails. The railroad car is typically provided with a side bearing disposed to opposite lateral sides of a longitudinal axs of the railroad car between a centerpiece or bolster of a wheeled truck and a portion of the body of the railroad car. As known in the art, and during movement of the railcar, each side bearing acts as an energy absorption apparatus and furthermore serves to control or restrict "hunting" movements of the railroad car.

Hunting is a phenomenon created by the wheeled trucks during movement of the railroad car over tracks or rails. The coned wheels of each truck travel a sinuous path along a tangent or straight track as they continually seek a centered position under the steering influence of the wheel conicity. In traveling such a sinuous path, a truck will yaw cyclically with respect to the car body about a vertical axis defined by a vertical centerline of the truck bolster. Of course, the truck also yaws or rotates quasi-statically with respect to the car body in negotiating curved track. As a result of the aforementioned cyclic yawing, "hunting" can occur as the yawing becomes unstable due to lateral resonance that can develop between the car body and the truck. As will be appreciated by those skilled in the art, excessive "hunting" can result in premature wear of the wheeled truck components including the wheels, bolsters and related equipment. Hunting can furthermore cause damage to the lading being transported in the car body.

Typically, a side bearing includes a base housing or cage which mounts to the bolster of the wheeled truck, a metal top plate and a spring disposed between the top plate and the base. In one form, the top plate and base are arranged in telescopic relation relative to each other. The spring of each side bearing is required to absorb the vertically directed forces placed on the side bearing by the car body as the railcar moves over the tracks. Moreover, the spring of each side bearing places a predetermined preload on the top plate. When assembled on the railroad car, this vertical force or preload of the spring acts essentially to keep the top plate in constant frictional contact with an underside of a portion of the railroad car body to restrict yaw axis motion of the wheeled truck. Thus, these type of energy absorption devices are sometimes referred to as constant contact side bearings. For purposes of this description, however, the term "side bearing" will be used throughout.

Recently different forms of thermoplastic elastomers have been used as the spring in side bearings to develop the required preload force to overcome hunting and to absorb the vertical forces imparted to the railcar side bearing. One such elastomeric spring is marketed and sold by the Assignee of the present invention under the tradename Tecs Pak. This form of resilient spring is formed from a HYTREL thermoplastic elastomer manufactured and sold by the DuPont Company.

As will be appreciated by those skilled in the art, as the wheeled truck yaws back and forth, the metal top plate of the side bearing slides across and relative to the underside of railroad car body. The resulting friction produces an opposite torque which acts to inhibit yaw motion. On certain side bearing applications, truck-hunting causes an excessive amount of heat to be produced at the interface between the top plate and the underside of the car body. The propensity of some wheeled trucks to hunt is beyond the ability/design of the side bearing to prevent. Such applications can be related to the railroad car design, truck type and other related design considerations.

The high levels of heat created by the friction between the metal top plate and underside of the car body are transferred to the elastomeric spring and tend to melt at least an upper area or surface of the elastomeric material forming the spring. Melting of the elastomeric spring significantly reduces the ability of the spring to apply a proper preload or force to the top plate of the side bearing thereby decreasing vertical suspension characteristics of the side bearing, thus, resulting in enhanced hunting of the wheeled truck. Of course, enhanced hunting or sideways movement of the wheeled truck increases the degree of sliding or relative movement between the top plate and undersurface of the car body leading to increased heat levels and further destruction of the elastomeric spring.

Thus, there is a need and a desire for a railroad car side bearing utilizing an elastomeric spring wherein the side bearing is configured to withstand the relatively high forces and heat generated by hunting movements of the wheeled truck relative to the railroad car body.

SUMMARY OF THE INVENTION

In view of the above, and in accordance with the present invention, there is provided a railcar side bearing including a housing, an upper member arranged in spaced relation relative to the housing, an elastomeric spring disposed between the housing and the upper member, and a thermal insulator for restricting heat transfer between the upper member of the railroad car side bearing and the elastomeric spring.

In one form, the top plate of the railcar side bearing includes an upper, generally flat surface for frictionally engaging an underside portion of the railroad car body. In a most preferred form of the invention, the top plate and base or housing of the railroad car side bearing are arranged in vertically spaced telescopic relation relative to each other with the elastomeric spring captively maintained therebetween.

The elastomeric spring of the present invention is preferably formed from a thermoplastic elastomer capable of imparting a predetermined preload or vertical force to the top plate of the railroad car side bearing so as to inhibit hunting movements of the wheeled truck as the railroad car moves over the tracks. In a most preferred form of the invention, the spring is formed from a Tecs Pak elastomeric material marketed and sold by the Assignee of the present invention. In the illustrated embodiment, the elastomeric material is formed from a thermoplastic elastomer having an elastic to plastic strain ratio greater than 1.5 to 1.

As will be appreciated from an understanding of this disclosure, the principals inherent with providing a thermal insulator in combination with the railroad car side bearing are equally applicable to substantially any shape or design of elastomeric spring member arranged in combination therewith. In a preferred form of the invention, the elastomeric spring has a generally cylindrical-like configuration between opposed ends. In a most preferred form of the invention, the elastomeric spring has a generally centralized bore opening at opposite ends to the opposed surfaces. The recesses at opposed ends of the elastomeric spring preferably accommodate guides projecting toward one another from the top plate and base of the railroad car side bearing thereby positioning the elastomeric spring relative to the other components of the side bearing.

A salient feature of the present invention involves operably disposing the thermal insulator between the railroad car side body and the elastomeric spring for restricting heat transfer to the elastomeric spring resulting from hunting movements of the wheeled truck relative to the car body. The thermal insulator is preferably formed from a glass filled polyesther material having relatively low thermal conductivity and a relatively high impact strength.

As will be appreciated by those skilled in the art, the thermal insulator will be configured to meet the particular needs and requirements of each particular application. In one form of the invention, the thermal insulator is disposed between one end of the elastomeric spring and an underside or undersurface of the top plate of the railroad car side bearing. The thermal insulator is preferably provided with spaced generally parallel surfaces. Testing has revealed, configuring the thermal insulator with a spacing of about 0.750 inches and about 1.250 inches between the generally parallel surfaces offers beneficial results. In a most preferred form of the invention, the thermal insulator defines a series of cavities between and opening to one of the generally parallel surfaces.

In those side bearings having a generally cylindrical-like elastomeric spring, the thermal insulator preferably has a generally disc-like configuration. The disc-like configuration of the thermal insulator has a diameter generally equal to the diameter across one end of the elastomeric spring. In a preferred form, the thermal insulator is configured to capture and position an end of the elastomeric spring thereby inhibiting shifting movement of the elastomeric spring and thermal insulator relative to each other.

As mentioned above, the top plate of some side bearings is provided with a projection or guide which sidably fits within a centralized bore of the elastomeric spring. In these type side bearings, the thermal insulator is configured with a generally centralized bore for allowing the guide on the upper member or top plate of the side bearing to pass endwise through the thermal insulator and into the bore in the elastomeric spring.

It is, therefore, a primary object of the present invention to provide a railroad car side bearing which utilizes an elastomeric spring to provide a preload force to a top plate or upper member of the side bearing and has a thermal insulator disposed in combination with and operably disposed between a portion of the car body normally engaged by a top surface of the side bearing to restrict heat transfer to the elastomeric spring resulting from hunting movements of the wheeled truck on which the railroad car side bearing is mounted.

Another object of the present invention is to provide a railroad car side bearing wherein the frictional energy or hunting between the side bearing and railroad car body remains to be dissipated by heat allowing the elastomeric spring associated with the side bearing to be thermally protected from damage resulting from such heat.

Still another object of the present invention is to provide a railroad car side bearing which utilizes an elastomeric spring which is protected against heat damage resulting from hunting movements of the wheeled truck on which the side bearing is mounted by a relatively simple inexpensive thermal insulator design.

These and other objects, aims and advantages of the present invention are more fully described in the following detailed description, the appended claims, and drawings.

DETAILED DESCRIPTION OF THE DRAWINGS

FIG. 1 is a top plan view of a portion of a railroad car wheeled truck including a side bearing according to the present invention;

FIG. 2 is an enlarged longitudinal sectional view of one form of side bearing embodying principals of the present invention; and FIG. 3 is a fragmentary top plan view of one form of thermal insulator according to the present invention.

DETAILED DESCRIPTION OF THE PRESENT INVENTION

While the present invention is susceptible of embodiment in various forms, there is shown in the drawings and will hereinafter be described a preferred embodiment of the invention with the understanding the present disclosure is to be considered as setting forth and exemplification of the invention which is not intended to limit the invention to the specific embodiment illustrated.

Referring now to the drawings, wherein like reference numerals indicate like parts throughout the views, a railroad car side bearing is schematically illustrated in FIG. 1 and is generally identified by reference numeral 10. As is conventional, the railroad car side bearing 10 is mounted on a railroad car 12 (FIG. 2). More specifically, the side bearing 10 is mounted on and in operative combination with a wheeled truck 14 forming part of a wheel set 15 which allows the railroad car 12 to ride along and over tracks 17. As is known, the side bearing 10 is mounted on a transversely positioned, partially illustrated, bolster 16 forming part of the wheeled truck 14 to operably support one end of a railroad car body 18 forming part of the railroad car 12.

The shape of the side bearing 10 is not an important consideration of the present invention. That is, the conventional side bearing 10 illustrated in FIG. 1 is intended only for illustrative purposes. It should be appreciated, however, the present invention is equally applicable to other forms or shapes of side bearings. As is conventional, the illustrated side bearing 10 includes a base housing or cage 26, a top plate or cap 28 positioned in vertically spaced relation relative to the base housing 26, and a spring 30 for applying a preload or vertical force to the top plate or cap 28 thereby restricting relative movement between the top plate or cap 28 and the car body 18. As discussed in detail hereinafter, the preload developed by the side bearing 10 is used to create frictional contact between the car body 18 and the top plate 28 thereby restricting hunting of the wheeled truck 14 as the railroad car 12 moves over the tracks 17.

In the side bearing 10 illustrated for exemplary purposes, the preferably metal housing 26 includes a base 32 configured for suitable attachment to the bolster 16 as through any suitable means. In the illustrated embodiment, base 32 includes diametrically opposed holes or openings 33*a* and 33*b* allowing suitable fasteners to extend endwise therethrough for fastening the base 32 to the bolster 16. In the illustrated embodiment, housing 26 further includes an integrally formed upwardly extending round wall 34 preferably extending 360 degrees around the housing 26 and defining an open top cavity or internal void 36. For purposes described hereinbelow, an upwardly extending guide or projection 38 is centrally located on the base 32 within the cavity 36 of housing 26. Preferably, the guide or projection 38 defines a generally flat or horizontal stop 39.

In the side bearing 10 illustrated for exemplary purposes, the preferably metal top plate or cap 28 includes a generally flat top surface 42 for frictionally engaging and establishing metal-to-metal contact with the car body 18. In the illustrated embodiment, top plate 28 further includes an integrally formed round wall 44 depending from an underside or undersurface 45 of top plate 28, preferably for 360 degrees, to define an open bottom cavity or internal void 46. As illustrated in FIG. 2, the round wall 34 of housing 26 is preferably sized to fit circumferentially about the round wall 44 of top plate 28 to allow the members or elements 26, 28 of the side bearing 10 to vertically move in generally telescopic relation relative to each other. In the illustrated form, the top plate 28 furthermore includes a guide or projection 48 centrally located within the cavity 46 and depending from the underside or undersurface 45 of the top plate 28. Preferably, the guide or projection 48 defines a generally flat or horizontal stop 49 disposed in confronting relation relative to the stop 39 on the guide or projection 38 of base 26. As will be appreciated by those skilled in the art, the stops 39 and 49 on the projections 38, 48, respectively, of base 26 and top plate 28 operate in combination relative to each other to limit the vertical displacement of the top plate 28 relative to the base 26 and thereby limit flexure of the elastomeric spring 30 as the railroad car 12 moves over the tracks 17.

Like the overall side bearing 10, the shape or form of the spring 30 can be varied or different from that illustrated without detracting or departing from the spirit and scope of the present invention. In the illustrated form, spring 30 for the side bearing 10 comprises a formed, resiliently deformable thermoplastic elastomer member 50 having a configuration suitable to accommodate insertion between the base housing or cage 26 and the top plate 28. The thermoplastic elastomer member 50, illustrated for example in FIG. 2, preferably includes a vertically elongated generally cylindrical configuration between opposed ends or surfaces 52 and 54. In a most preferred form, the thermoplastic elastomer member 50 has a centrally disposed hole or aperture 56 extending therethrough and opening to the opposite ends 52 and 54 thereof. It should be appreciated, however, the thermoplastic elastomer member 50 could likewise be solidly configured without detracting or departing from the spirit and scope of the present invention. Moreover, the elastomer member 50 could be formed as a composite structure similar to that disclosed in coassigned and copending U.S. patent application Ser. No. 08/840,306 to David G. Anderson herein incorporated by reference to the extent applicable.

Suffice it to say, the thermoplastic elastomer 50 can be formed from a myriad of elastomeric materials. Preferably, the thermoplastic elastomer member 50 is formed from a copolyesther polymer elastomer manufactured and sold by DuPont Company under the name HYTREL. Ordinarily, however, a HYTREL elastomer has inherent physical properties that make it unsuitable for use as a spring. Applicant's assignee, however, has discovered that after shaping HYTREL into the appropriate configuration, it is possible to advantageously impart spring-like characteristics to the elastomeric member 50. U.S. Pat. No. 4,198,037 describes the above noted polymer material and forming process and is herein incorporated by reference to the extent applicable. When used as a spring 30 the elastomer member has an elastic to plastic strain ratio greater than 1.5 to 1.

As will be readily appreciated by those skilled in the art, the purpose of spring 30 is to position the top plate 28 relative to the base 26 and to develop a predetermined preload or vertical force thereby urging the top surface 42 of top plate 28 toward and into frictional engagement with a portion of the railroad car body 18. The preload or vertically directed force on the top plate 28 allows absorption of vertically directed forces imparted to the side bearing 10 when the car body 18 tends to roll, i.e. oscillate about a horizontal axis of the car body 18 and furthermore inhibits hunting movements of the wheeled truck 14 relative to the car body 18.

As will be appreciated by those skilled in the art, during travel of the railroad car 12, the wheeled truck 14 naturally hunts or yaws about a vertical axis of the truck 14 thus establishing frictional sliding movements at the interface of the top surface of the side bearing's upper member, for example the top surface 28 and the underside of the car body 18, thereby generating significant and even excessive heat. This excessive heat is detrimental to and sometimes effects melting of the thermoplastic material forming the spring 30.

Accordingly, a salient feature of the present invention relates to the provision of a thermal insulator 60 operably disposed between the car body 18 and the spring 30 for restricting transfer of heat to the elastomeric spring 30 resulting from hunting movements of the wheeled truck 14 relative to the car body 18. The thermal insulator 60 must have two important characteristics. First, the insulator 60 must restrict the transfer of heat therethrough. Second, the thermal insulator must have sufficient strength and durability to withstand the mechanical cyclic and impact loading applied thereto.

Mechanical cyclic loading of the thermal insulator occurs when the car body 18 and the top plate 28 of the side bearing 10 vertically move in concert with one another as the car moves across the tracks. Impact loading of the thermal insulator 60 occurs when the car body 18 and top plate or cap 28 of the side bearing 10 momentarily separate vertically from each other and are then abruptly brought into contact with each other as the railroad car moves over the tracks. Testing has revealed a glass filled polyester material of the type sold by DuPont under the tradename RYNITE appears to offer beneficial performance characteristics including relatively low thermal conductivity and relatively high strength to withstand mechanical cyclic and impact loading applied thereto.

The shape of the thermal insulator 60 is dependent upon different factors. First, the configuration of the elastomeric spring 30 can influence the shape of the thermal insulator 60. Second, the disposition of the thermal insulator 60 relative to the interface between the car body 18 and elastomeric spring 30 can furthermore influence the shape of the thermal insulator 60.

In the side bearing 10 illustrated for exemplary purposes, the thermal insulator 60 is disposed between the underside or undersurface 45 of the top plate 28 and the end surface 52 of the elastomeric spring 30. In the illustrated form of the invention, the thermal insulator 60 has a round disc-like configuration with a diameter at least equal to the diameter across the end surface 52 of spring 30. As shown, the thermal insulator 60 is preferably configured with a pair of generally parallel spaced planar surfaces 62 and 64.

When the illustrated side bearing 10 is assembled with the thermal insulator 60, surface 62 of the insulator 60 preferably abuts with the end surface 52 of the elastomeric spring 30 while surface 64 preferably abuts with the underside or surface 45 of the top plate 28. Preferably, surfaces 62 and 64 are spaced apart a distance ranging between about 0.750 inches and about 1.250 inches. Testing has revealed a distance of about 1.00 inches between the planar surfaces 62 and 64 appears to work well in restricting transference of heat between the interface of the car body 18 and the top plate 28 to the elastomeric spring 30 as a result of hunting movements of the wheeled truck 14.

To reduce the weight thereof without significantly effecting the thermal insulating properties thereof, a preferred form of thermal insulator 60 includes a plurality of side-by-side pockets or cavities 66 between the spaced surfaces 62 and 64. As shown in FIG. 3, the thermal insulator 60 defines a series of radially extending ribs 68 extending between the opposed surfaces 62 and 64 for compressive strength purposes while serving to separate adjacent pockets 66 from each other. In a preferred form of the invention, the pockets 66 open to one of the surfaces 62, 64 defined by the insulator 60. In the illustrated form of the invention, the pockets 66 open to the top side or surface 64 of the thermal insulator 60.

A preferred form of thermal insulator 60 is furthermore configured to inhibit shifting or sideways movements of the thermal insulator 60 relative to the elastomeric spring 30. In the example shown in FIG. 2, the thermal insulator 60 is preferably provided with a generally centralized bore or aperture 70 opening at opposite ends to the opposed surfaces 62, 64 on the insulator 60. The bore or aperture 70 is sized to allow the projection or guide 48 of top plate 28 to extend therethrough and into the recess 56 defined by the spring 30. As such, the thermal insulator 60 fits about the projection or guide 48 and is inhibited from shifting sideways relative to the spring 30.

In the illustrated form of the invention, the thermal insulator 60 is furthermore configured with depending structure 74 for capturing and positively positioning one end of the spring 30 thereby inhibiting shifting sideways movements therebetween. As shown, the thermal isolator 60 is preferably provided with a skirt 76 depending from the planar surface 62. As will be appreciated by those skilled in the art, the skirt surrounds and captures an upper end portion of the spring 30 thereby positioning the spring 30 and thermal isolator 60 relative to each other.

In some instances, the elastomeric spring 30 and heat shield or thermal insulator 60 are sized relative to each other to form a subassembly having a specific cumulative height. Moreover, in some instances, it may be desirous to ship or transport the elastomeric spring 30 and thermal insulator or shield 60 as a subassembly for subsequent installation as a repair part on a side bearing 10. Accordingly, in one form of the invention, the elastomeric spring 30 and thermal shield 60 may be operably coupled in relation to each other. The coupling between the elastomeric spring 30 and thermal shield or insulator can take a variety of forms without detracting or departing from the spirit and scope of the present invention. For example, in one form, surface 52 on the elastomeric spring 30 and surface 62 on the thermal shield 60 can be mechanically attached to each other using suitable prongs, interconnecting projections or the like. Alternatively, a suitable adhesive can be used to bond the elastomeric spring 30 and thermal shield 60 in proper relation relative to each other. In the instance where adhesive is used, a polyurethane water based adhesive may be best suited to bond the elastomeric spring 30 and the thermal shield 60 to each other. Preferably, such adhesive is applied about the skirt 76 of the thermal insulator 60 to bond or couple the adjacent area of the elastomeric spring 30 thereto.

It will be understood from the foregoing structural description that the provision of thermal insulator 60 between the elastomeric spring 30 and the interface of the top surface 42 of the upper member 28 with the body 18 of the railroad car 12 restricts heat transfer to the elastomeric spring 30. As will be appreciated, inhibiting or restricting heat transfer to the elastomeric spring 30 yields several advantageous results. To dissipate friction between the interacting surfaces of the side bearing 10 and car body 18, there remains a desire for heat. The present invention does nothing to adversely effect the transference of hunting energy to heat. Instead, the present invention simply restricts the transference of heat to the elastomeric spring 30 of the side bearing 10. Thus, the elastomeric spring 30 and thereby the side bearing 10 is permitted to operate in the manner for which it was designed without concern over deteriorating conditions resulting from the heat damaging or destroying the elastomeric spring 30.

With a preferred form of the present invention, the thermal isolator 60 and elastomeric spring 30 are positively maintained in position relative to each other to achieve optimum performance. In one form of the invention, the depending guide 48 on the top or upper member 28 of the side bearing 10 freely passes through the thermal insulator 60 and engages the recess at the end of the elastomeric spring 30 thereby inhibiting shifting movements between the thermal isolator 60 and the spring 30. According to a preferred form of the invention, the depending structure 70 about the periphery of the isolator 60 positively engages and holds the free end of the spring 30 thereby preventing shifting movements of the spring 30 relative to the isolator 60.

A primary function of the thermal isolator 60 is to protect the elastomeric spring 30 of the railroad car side bearing 10 against heat damage resulting from hunting movements of the wheeled truck 14 utilizing a simplistic and cost effective design. With the present invention, performance of the railroad car side bearing 10 is enhanced and prolonged notwithstanding adverse conditions without significant design changes being required for the conventional railroad car side bearing housings 26, 28. Additionally, minimal changes are required to the elastomeric spring 30 of a conventional railroad car side bearing 10 when the thermal insulator 60 is arranged in protective combination therewith.

From the foregoing, it will be observed that numerous modifications can be effected without departing from the true spirit and scope of the novel concept of the present invention. It will be appreciated that the present disclosure is intended to set forth an example of the present invention. The example set forth, however, is not intended to limit the invention to that particular embodiment illustrated and discussed. The disclosure is intended to cover by the appended claims all such modifications as fall within the spirit and scope of the claims.

What is claimed is:

1. A railroad car side bearing configured for insertion between a railroad car body and a wheeled truck arranged toward and supporting one end of said car body, said side bearing comprising:

a base;

a top plate arranged in vertically spaced relation relative to said base, said top plate including a generally flat surface for frictionally engaging a portion of said car body;

an elastomeric spring operably disposed between said base and said top plate for urging said top plate toward said portion of said car body to restrict hunting of the wheeled truck; and a thermal insulator operably disposed between said car body and said elastomeric spring for restricting heat transfer to said elastomeric spring resulting from hunting movements of the wheeled truck relative to said car body.

2. The railroad car side bearing according to claim 1 wherein said top plate and said base are arranged in telescopic relation relative to each other.

3. The railroad car side bearing according to claim 1 wherein said elastomeric spring is comprised of a material having an elastic to plastic strain ratio greater than 1.5 to 1.

4. The railroad car side bearing according to claim 1 wherein said thermal insulator is disposed between a top surface of said elastomeric spring and an undersurface of said top plate.

5. The railroad car side bearing according to claim 1 wherein said thermal insulator includes upper and lower generally parallel surfaces which are spaced apart by a distance ranging between about 0.750 inches and about 1.250 inches.

6. The railroad car side bearing according to claim 5 wherein said thermal insulator defines a series of open top cavities disposed between said upper and lower surfaces.

7. The railroad car side bearing according to claim 1 wherein said thermal insulator is formed from a glass filled polyesther material having relatively low thermal conductivity and relatively high impact strength.

8. The railroad car side bearing according to claim 1 wherein said elastomeric spring has a generally cylindrical-like configuration between opposed ends thereof.

9. The railroad car side bearing according to claim 1 wherein said elastomeric spring has recesses opening to opposite ends thereof.

10. The railroad car side bearing according to claim 1 wherein said elastomeric spring has a centrally disposed aperture opening at opposite ends to upper and lower surfaces of said elastomeric spring.

11. The railroad car side bearing according to claim 1 wherein said thermal insulator includes depending structure for accommodating and capturing one end of said elastomeric spring thereby positively positioning said thermal insulator and said spring relative to each other.

12. An energy absorption apparatus configured for absorbing energy between two masses, said energy absorption apparatus comprising:

a base attached to one of said masses;

a member arranged in axially spaced relation relative to said base, said member defining a surface for frictionally and movably engaging another mass;

an elastomeric spring operably disposed between said base and said member for urging the surface of said member into a predetermined position relative to said base, said elastomeric spring furthermore serving to absorb and rebound from energy imparted to the surface of said member; and a thermal insulator operably disposed between said another mass and said elastomeric spring for restricting heat transfer to said elastomeric spring resulting from the surface on said member moving relative to and thus creating heat from engagement with said another mass.

13. The energy absorption apparatus according to claim 12 wherein said elastomeric spring is formed from a thermoplastic elastomer having an elastic to plastic strain ratio greater than 1.5 to 1.

14. The energy absorption apparatus according to claim 12 wherein said thermal insulator includes a pair of generally parallel surfaces, with one of said surfaces being arranged in contact with one end of said elastomeric spring.

15. The energy absorption apparatus according to claim 14 wherein a distance of about 1 inch is provided between said generally parallel surfaces of said thermal insulator.

16. The energy absorption apparatus according to claim 14 wherein said thermal insulator defines a plurality of cavities between and opening to one of said generally parallel surfaces for reducing the weight of said thermal insulator while maintaining a relatively low thermal conductivity therefor.

17. The energy absorption apparatus according to claim 12 wherein said thermal insulator is formed from a glass filled polyesther material having relatively low thermal conductivity and relatively high impact strength.

18. The energy absorption apparatus according to claim 12 wherein said thermal insulator is configured to capture one end of said spring to inhibit shifting movements therebetween.

19. The energy absorption apparatus according to claim 12 wherein said elastomeric spring has a generally cylindrical-like configuration between opposed ends thereof.

20. The energy absorption apparatus according to claim 18 wherein said elastomeric spring defines a bore extending therethrough and opening to said opposed ends thereof.

21. A railroad car side bearing, comprising:

a housing;

an upper member arranged in spaced relation relative to said housing;

an elastomeric spring disposed between said housing and said upper member, and a thermal insulator for restricting heat transfer between said upper member and said elastomeric spring.

22. The railroad car side bearing according to claim 21 wherein said base and said upper member are arranged in telescopic relation relative to each other.

23. The railroad car side bearing according to claim 21 wherein said elastomeric spring is formed from a thermoplastic elastomer having an elastic to plastic strain ratio of about 1.5 to 1.

24. The railroad car side bearing according to claim 21 wherein said thermal insulator includes generally parallel surfaces which are spaced apart by a distance measuring between about 0.750 inches and about 1.250 inches.

25. The railroad car side bearing according to claim 24 wherein said thermal insulator defines a plurality of cavities between and opening to one of said generally parallel surfaces.

26. The railroad car side bearing according to claim 21 wherein said thermal insulator is formed from a glass filled polyesther material having relatively low thermal conductivity and relatively high impact strength.

27. The railroad car side bearing according to claim 21 wherein said elastomeric spring has a generally cylindrical-like configuration between opposed ends thereof.

28. The railroad car side bearing according to claim 27 wherein said thermal insulator has a generally disc-like configuration with a diameter generally equal to a diameter across one end of said elastomeric spring.

29. The railroad car side bearing according to claim 21 wherein said elastomeric spring has a generally cylindrical-like configuration and a generally centralized bore opening to opposed ends of said elastomeric spring.

30. The railroad car side bearing according to claim 29 wherein said base includes a guide which projects into one end of the bore defined by said elastomeric spring for operably positioning said elastomeric spring relative to said base.

31. The railroad car side bearing according to claim 29 wherein said upper member includes a guide which projects into one end of the bore defined by said elastomeric spring for operably positioning said elastomeric spring relative to said base.

32. The railroad car side bearing according to claim 31 wherein said thermal insulator has a generally disc-like configuration with a diameter at least equal to a diameter across one end of said elastomeric spring.

33. The railroad car side bearing according to claim 32 wherein said thermal insulator defines a generally centralized bore for allowing the guide on said upper member to pass endwise therethrough and into the bore in said elastomeric spring.

34. The railroad car side bearing according to claim 21 wherein said thermal insulator is configured to capture and position an end of said elastomeric spring thereby inhibiting shifting movements of the elastomeric spring relative to said thermal insulator.

35. An elastomeric spring assembly for a railroad car side bearing having a housing with an upper member arranged in spaced relation relative to said housing, said elastomeric spring assembly comprising:

an elastomeric spring member configured to fit between and arrange said upper member in spaced relation relative to said housing; and a thermal insulator for inhibiting heat transfer between said upper member and said elastomeric spring member.

36. The elastomeric spring assembly according to claim 35 wherein said elastomeric spring member is formed from a thermoplastic elastomer having an elastic to plastic strain ratio of about 1.5 to 1.

37. The elastomeric spring assembly according to claim 35 wherein said thermal insulator includes generally parallel surfaces which are spaced apart a distance measuring between about 0.750 inches and about 1.250 inches.

38. The elastomeric spring assembly according to claim 37 wherein said thermal insulator defines a plurality of cavities between and opening to one of said generally parallel surfaces.

39. The elastomeric spring assembly according to claim 35 wherein said thermal insulator is formed from a glass filled polyesther material having relatively low thermal conductivity and relatively high impact strength.

40. The elastomeric spring assembly according to claim 35 wherein said elastomeric spring member has a generally cylindrical-like configuration between opposed ends thereof.

41. The elastomeric spring assembly according to claim 35 wherein said thermal insulator has a generally disc-like configuration with a diameter generally equal to a diameter across one end of said elastomeric spring member.

42. The elastomeric spring assembly according to claim 35 wherein said elastomeric spring member defines a bore opening to opposed surfaces on said elastomeric spring member.

43. The elastomeric spring assembly according to claim 37 wherein said elastomeric spring member defines a generally centralized bore opening to one of said parallel surfaces on said thermal insulator.

44. The elastomeric spring assembly according to claim 43 wherein said thermal insulator defines a generally centralized bore for allowing a guide on said upper member to pass endwise therethrough and into the bore in said elastomeric spring member.

45. The elastomeric spring assembly according to claim 35 wherein said thermal insulator is configured to capture and position an end of said elastomeric spring member thereby inhibiting shifting movements of the elastomeric spring member relative to said thermal insulator.

46. The elastomeric spring assembly according to claim 35 wherein said thermal insulator is attached to said elastomeric spring member.

47. The elastomeric spring assembly according to claim 35 wherein said thermal insulator is disposed between an end of said spring member and said upper housing on said railroad car side bearing.

48. An elastomeric spring assembly for a railroad car side bearing having a housing with an upper member arranged in spaced relation relative to said housing, said elastomeric spring assembly comprising:

an elastomeric spring member having a lower surface for engaging said housing and an upper surface for engaging said upper member; and a thermal insulator disposed between said upper member and said elastomeric spring member.

49. The elastomeric spring assembly according to claim 48 wherein said elastomeric spring member is formed from a thermoplastic elastomer having an elastic to plastic strain ratio of about 1.5 to 1.

50. The elastomeric spring assembly according to claim 48 wherein said upper and lower surfaces of said thermal insulator extend generally parallel to each other.

51. The elastomeric spring assembly according to claim 48 wherein a spacing ranging between about 0.750 inches and about 1.250 inches is provided between said upper and lower surfaces of said thermal insulator.

52. The elastomeric spring assembly according to claim 48 wherein said thermal insulator defines a plurality of cavities between and opening to at least one of said upper or lower surfaces on said thermal insulator.

53. The elastomeric spring assembly according to claim 48 wherein said thermal insulator is formed from a glass filled polyesther material having relatively low thermal conductivity and relatively high impact strength.

54. The elastomeric spring assembly according to claim 48 wherein said elastomeric spring member has a generally cylindrical-like configuration between opposed ends thereof.

55. The elastomeric spring assembly according to claim 54 wherein said thermal insulator has a generally disc-like configuration with a diameter generally equal to a diameter across one end of said elastomeric spring member.

56. The elastomeric spring assembly according to claim 48 wherein said elastomeric spring member defines a generally centralized bore opening to opposed surfaces on said elastomeric spring member.

57. The elastomeric spring assembly according to claim 48 wherein said elastomeric spring member defines a generally centralized bore therein opening to at least one end thereof.

58. The elastomeric spring assembly according to claim 57 wherein said thermal insulator defines a generally centralized bore for allowing a guide on said upper member to pass endwise therethrough and into the bore in said elastomeric spring member.

59. The elastomeric spring assembly according to claim 48 wherein said thermal insulator is configured to capture and position an end of said elastomeric spring member thereby inhibiting shifting movements of the elastomeric spring member relative to said thermal insulator.

60. The elastomeric spring assembly according to claim 48 wherein said thermal insulator is attached to said elastomeric spring member.

* * * * *